US005085625A

United States Patent [19]

Kojima

[11] Patent Number: 5,085,625

[45] Date of Patent: Feb. 4, 1992

[54] CHOPPER FOLD DEVICE FOR A FOLDER

[75] Inventor: Noriyuki Kojima, Chiba, Japan

[73] Assignee: Komori Corporation, Tokyo, Japan

[21] Appl. No.: 679,804

[22] Filed: Apr. 3, 1991

[30] Foreign Application Priority Data

Apr. 23, 1990 [JP] Japan ..... 2-105257

[51] Int. Cl.[5] ..... B65H 37/06; B65H 45/18

[52] U.S. Cl. ..... 493/444; 493/437; 493/476; 83/630

[58] Field of Search ..... 493/437, 444, 445, 468, 493/475, 476; 74/44; 83/629, 630; 270/45

[56] References Cited

U.S. PATENT DOCUMENTS 3,059,594 10/1962 Suay ..... 74/44
3,745,868 7/1973 Prentice ..... 83/630
4,419,929 12/1983 Dommer et al. ..... 83/630
4,568,319 2/1986 Samata et al. ..... 493/444

FOREIGN PATENT DOCUMENTS 2247517 6/1973 Fed. Rep. of Germany ..... 493/437
2247707 7/1973 Fed. Rep. of Germany ..... 493/437

*Primary Examiner*—Bruce M. Kisliuk
*Assistant Examiner*—Jack Lavinder
*Attorney, Agent, or Firm*—Abelman Frayne & Schwab

[57] ABSTRACT

A chopper type fold device includes a chopper blade supported by at least two linear feeding crank mechanisms provided along a longitudinal direction of the chopper blade, each linear feeding crank mechanism comprising two crank members mutually rotating in opposite directions and two connecting rods having the same length, the upper end of each connecting rod being connected to one of the crank members, the lower end of each connecting rod being coaxially connected to an upper end of the chopper blade.

5 Claims, 6 Drawing Sheets

CHOPPER FOLD DEVICE FOR A FOLDER

FIELD OF THE INVENTION

The present invention relates to a chopper type folding device for a web in an offset printing press.

BACKGROUND OF THE INVENTION

A crank chopper method (another name, an arm method) is known for folding parallel folded objects along a line perpendicular to a cutting surface by use of a chopper blade.

Recently, several methods have been developed by reducing inertia of the chopper blade so as to increase the machine operating speed and vertically move the chopper blade so as to increase the folding accuracy. For example, as shown in FIG. 6, German Federal Republic Laid-Open Application No. 2247707 discloses a device for driving a folding knife.

In that application, a linearly feeding crank mechanism (a slider crank mechanism) A is utilized incorporating a belt or a chain 1, a wheel 2 on which the belt or the chain is wound, a crank shaft 3 integrally attached to the wheel 2, a crank 4 integrally connected to the crank shaft 3, a connecting rod 5 connected to the crank 4 with a pin, a slider 6 connected to the connecting rod 5 by a pivot, and a linear guide 7. A folded object W on a folding table 9 is inserted between folding rollers 10 by vertically moving downwardly a folding knife 8, which is integrally connected to the slider 6.

However, the slider 6 and the linear guide 7 are necessary for the linearly feeding crank mechanism A. Therefore, the size of the mechanism becomes large, and the durability of the mechanism is reduced due to the a sliding surface of the slider can be coming abraded.

OBJECT OF THE INVENTION

A purpose of the present invention is to provide a chopper type folding device of simplified construction and of enhanced durability, even though the device employs a linear feeding crank mechanism.

SUMMARY OF THE INVENTION

According to the present invention, the chopper blade is supported by at least two linear feeding crank mechanisms provided at opposite ends of the chopper blade. The linear feeding crank mechanisms each comprise two rotary member of equal planar arranged in a pair and mutually rotating in opposite directions each other. Two connecting rods of equal length, are connected to the rotary members by bending pins at there upper ends, and the lower ends thereof are coaxially connected to an upper end of the chopper blade by a bearing pin.

The two connecting rods in each pair move towards and away from each other at ther upper ends by rotation of the two rotary members in each pair, so that the chopper blade is moved up and down in a vertical direction in the absebce of swinging the chopper blade. Preferably, the rotary members are provided by gears having teeth meshed with teeth of the next adjacent gear, whereby rotation of the respective gears is synchronized in the extent of their angular movement.

DETAILED DESCRIPTION OF THE PREFERRED EMBODIMENTS

Figure 1:
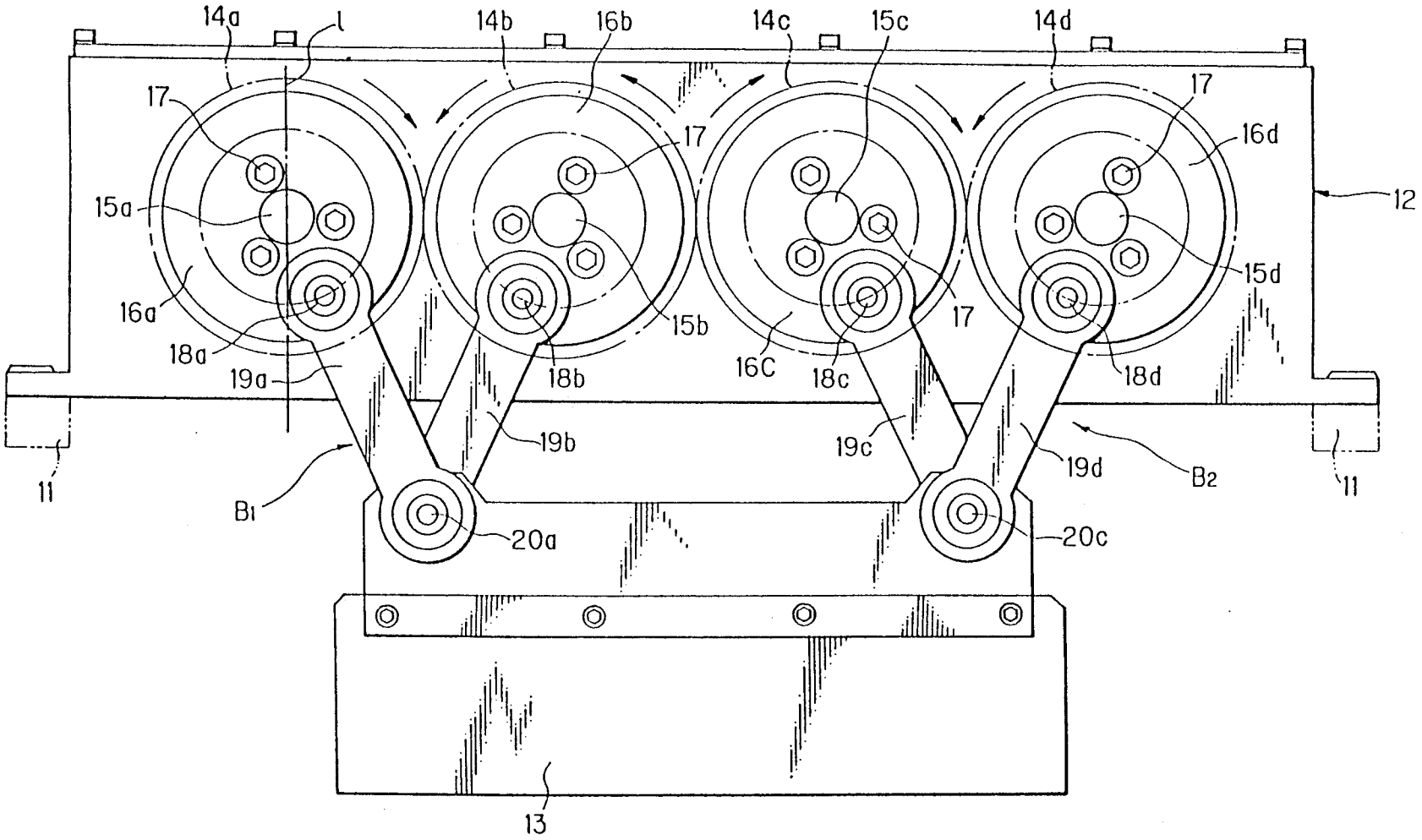
FIG. 1 shows a side view of one embodiment of the present invention.
Figure 2:
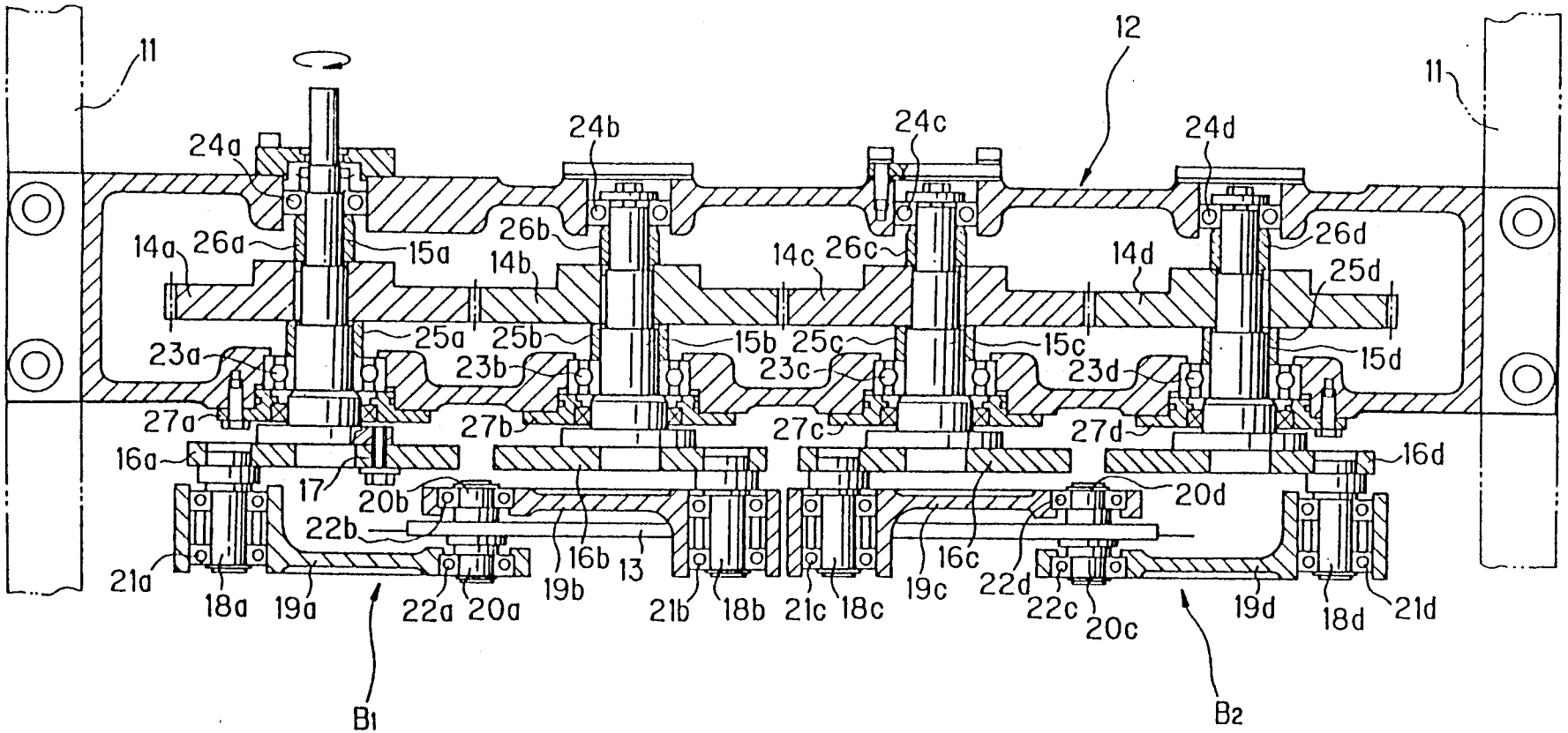
FIG. 2 shows a transverse cross section of the embodiment as shown in FIG. 1.
Figure 3:
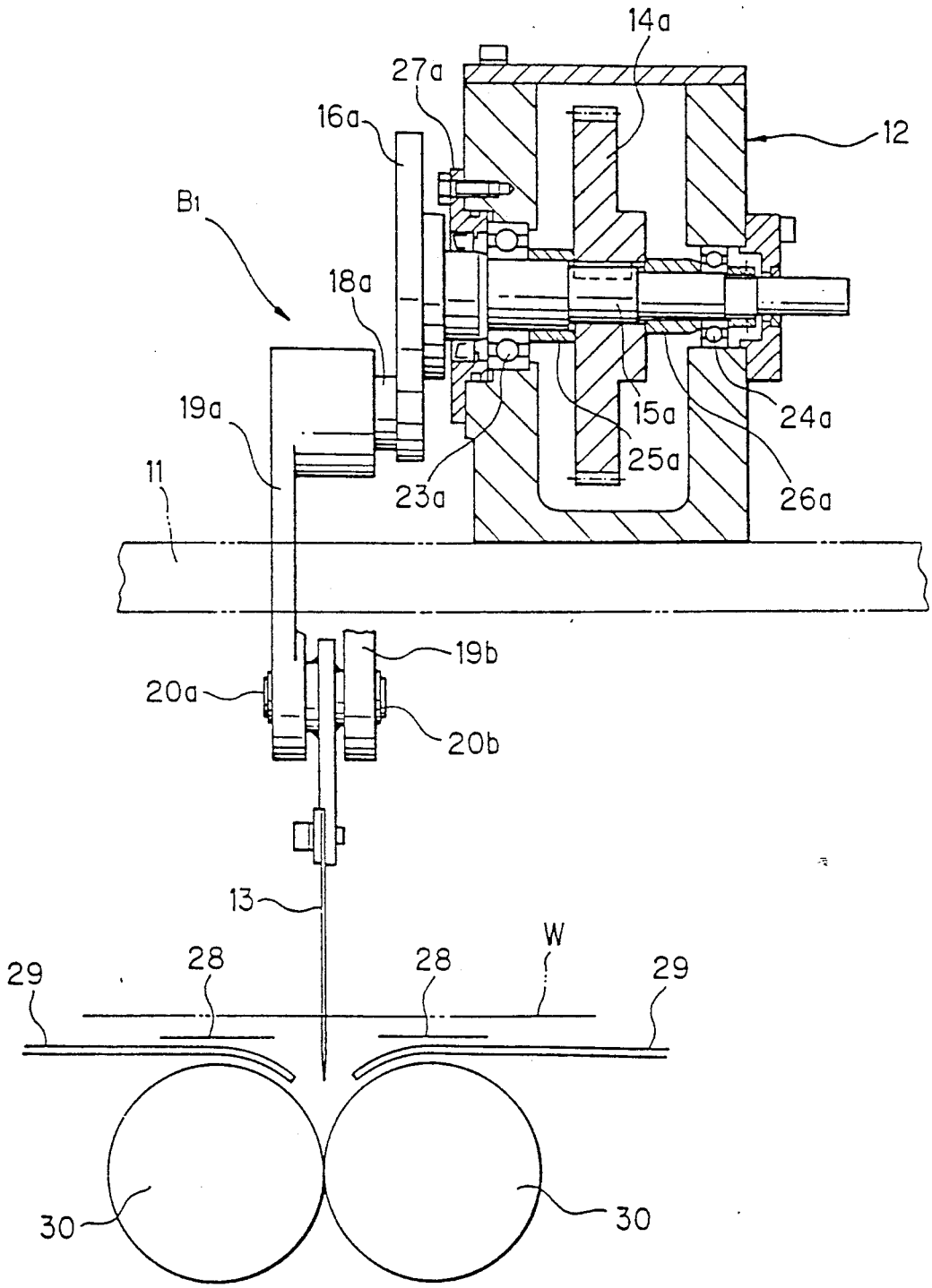
FIG. 3 shows a longitudinal cross section of the embodiment as shown in FIG. 1.

As shown in FIG. 1 to FIG. 3, a gear box 12 is fixedly supported between a pair of left and right main frame members 11 for it to extend transverse to the main frame members 11 direction of feeding of object W. A chopper blade 13 is hung from the gear box 12 through two sets of a front linear feeding crank mechanism B1 and B2.

Four identical spur gears 14*a*–14*d* are supported in the gear box 12 through rotational axles 15*a*–15*d*, respectively. In the gear box 12, each gear 14 engages with an adjacent gear 14.

The front end rotational axle 15*a* is rotatory driven as a driving shaft by a driving device (not shown) which is connected to one end of the rotational axle 15*a*.

The linear feeding crank mechanism B1 is formed by the two spur gears 14*a*, 14*b* and the rotational axles 15*a*, 15*b*. The linear feeding crank mechanism B2 is formed by the two spur gears 14*c*, 14*d* and the rotational axles 15*c*, 15*d*.

Discs 16*a*–16*d* of equal diameter are coaxially fixed as a crank member at an end of the rotational axles 15*a*–15*d* by bolts 17. Two links 19*a*, 19*b* are pivotally connected, respectively to hung from a respective the two discs 16*a*, 16*b* at one side of the gear box 12 through an off-set bearing pins 18*a*, 18*b*, and are coaxially fixed to the adjacent end portion of the chopper blade 13 with a bearing pin 20*a*, 20*b*. The two links 19*c*, 19*d* are similarly supported from the discs 16*c*, 16*d* through an off-set bearing pins 18*c*, 18*d*, and are coaxially fixed at their lower end portions to the chopper blade 13 by bearing pins 20*c*, 20*d*.

The four links 19*a*–19*d* have the same length as each other and are connected to the off-set pins 18*a*–18*d* through ball bearings 21*a*–21*d* and the pins 20*a*–20*d* through ball bearings 22*a*–22*d*, respectively.

In the drawings, numerals 23*a*–23*d* and numerals 24*a*–24*d* indicate ball bearings, and numerals 25*a*–25*d* and numerals 26*a*–26*d* indicate sleeves. Numerals 27*a*–27*d* indicate bearing caps. In FIG. 3, numeral 28 indicates a feeding belt, numeral 29 indicates a folding table, and numeral 30 indicates a folding roller.

When the rotational axle 15*a* is rotated clockwise by the driving device (not shown), the first disc 16*a* and the third disc 16*c* from the front side rotate clockwise and the second disc 16*b* and the fourth disc 16*d* rotate counterclockwise due to the engagement of the spur gears 14*a*–14*d* (see arrows in FIGS. 1 and 2).

Figure 4:
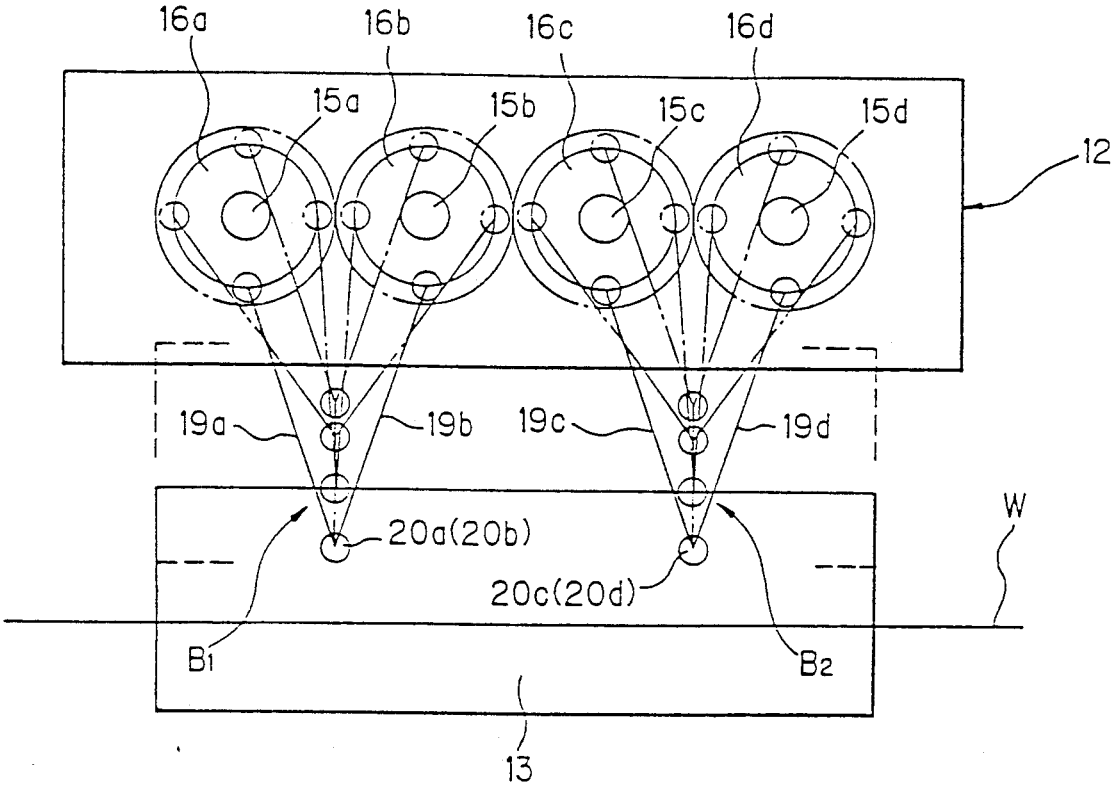
FIG. 4 shows working principle of a linearly feeding crank mechanism of the embodiment.

Thereby, in accordance with working principle of the linear feeding crank mechanism B1, B2 as shown in FIG. 4, each pair of the links 19*a* and 19*b*, 19*c* and 19*d* is opened and closed so as to synchronously move two connecting points 20*a* and 20*b*, 20*c* and 20*d* with respect to the chopper blade 13 upwards and downwards. The chopper blade 13 thus moves up and down without any swinging movement of the chopper blade, and, the object W on the feeding belts 28 is accurately folded between the folding rollers 30.

Figure 5:
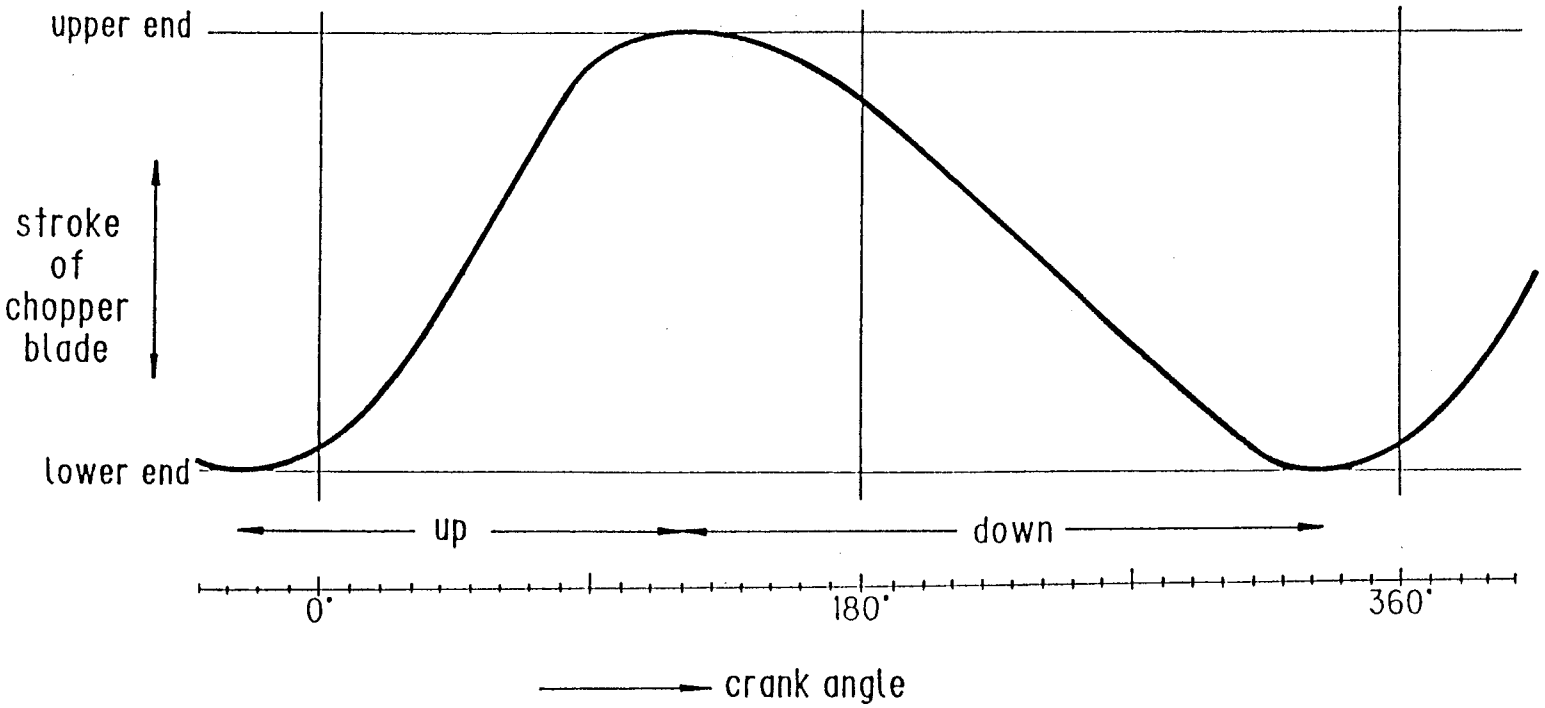
FIG. 5 shows elevation velocity curve of the chopper blade of the embodiment.
Figure 6:
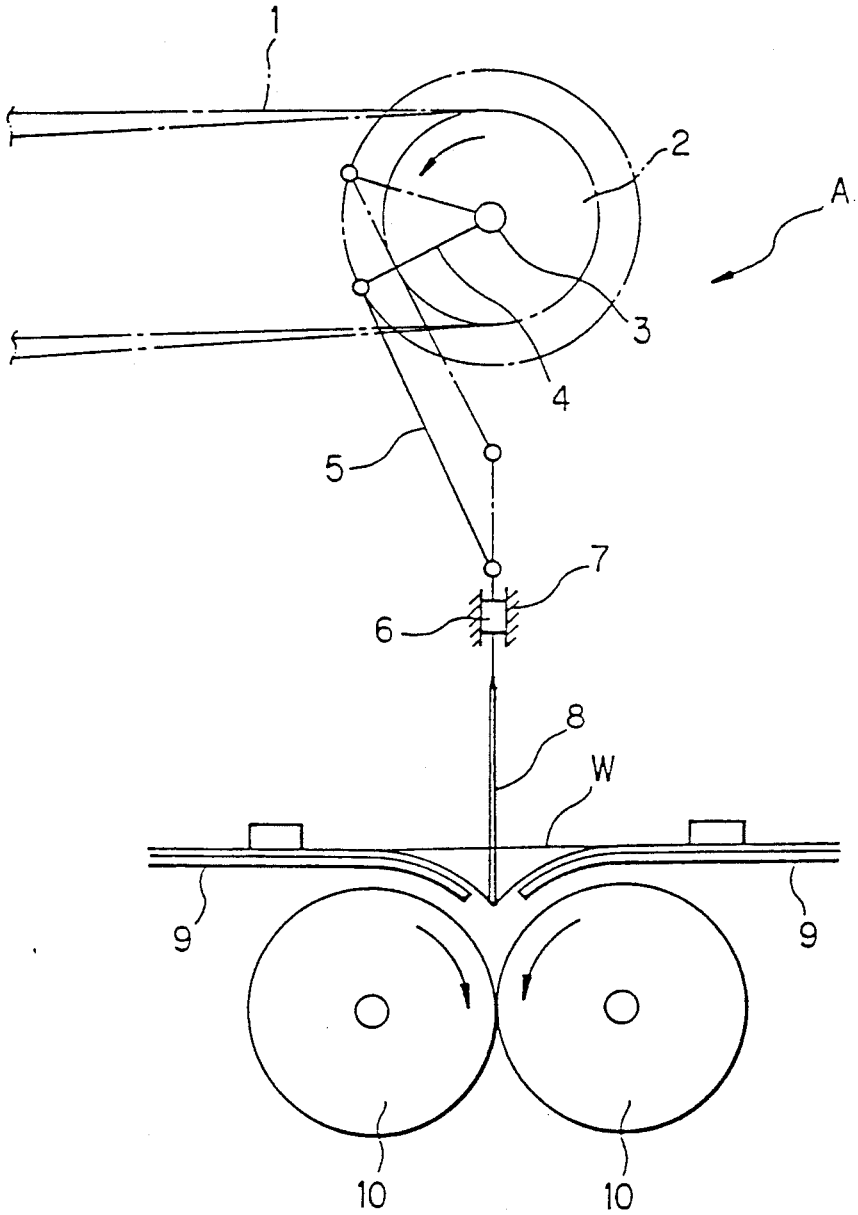
FIG.6 Prior art
FIG. 6 shows a schematic drawing of the conventional embodiment.

During vertical upward and downward movement of the chopper blade 13, the connecting point 18*a* to 18*d* of each link 19*a*–19*d* is shifted with respect to a perpendicular line 1 crossing a shaft center of the rotational axles 15*a*–15*d*, respectively. Thereby the velocity of the chopper blade 13 during the upward movement and the downward movement are different each other as clearly shown in FIG. 5. FIG. 5 shows an elevation characteristic of the chopper blade 13. In FIG. 5, x-axis and y-axis shows crank angle and stroke of the chopper blade 13, respectively. As shown in FIG. 5, the gradient is steep and a period of the upward movement is shorter during the upward movement. On the other hand, the gradient is gentle and a period of the downward movement is longer during the downward movement. Accordingly, a preferable elevator velocity can be selected by changing a rotational direction of each disc 16*a*–16*d*.

The present invention is not limited by the above embodiment. Various minor modifications are suggested, such as driving each rotational axle 15*a*–15*d* individually, or providing additional linear feeding crank mechanisms at an intermediate positions along the chopper blade 13. Bar-shaped cranks can be employed instead of discs 16*a*–16*d*.

What is claimed is:

1. A chopper type folding device wherein a chopper blade is supported by at least two linear feeding crank mechanisms along a longitudinal direction of said chopper blade, characterized that each said linear feeding crank mechanism comprises:

a pair of oppositely rotating crank members along said longitudinal direction of said chopper blade, each said crank member having the same throw, and two connecting rods each having an upper end connected to one of said each of crank members by a bearing pin and lower ends coaxially connected to an upper end of said chopper blade by a bearing pin, respectively, each said connecting rod being of equal length, whereby the chopper blade reciprocates to fold a sheet of material between two folding rollers.

2. A chopper type folding device as claimed in claim 1, wherein said crank members are synchronized in rotation through a gear transmission mechanism.

3. A chopper type folding device as claimed in claim 1, wherein said crank members are driven by a driving device of a printing press machine.

4. A chopper type folding device as claimed in claim 1, wherein said crank members are driven by a motor connected to at least one of said crank members.

5. A chopper type folding device as claimed in claim 1, wherein each said crank members is a rotary disc coaxially connected to a rotational axle.

* * * * *